United States Patent [19]

Aubert

[11] Patent Number: 4,772,431

[45] Date of Patent: Sep. 20, 1988

[54] PROCESS FOR THE IMMOBILIZATION OF NUCLEAR WASTE IN A BOROSILICATE GLASS

[75] Inventor: Bruno Aubert, Marignan, France

[73] Assignee: Societe Generale Pour les Techniques Nouvelles, France

[21] Appl. No.: 35,052

[22] Filed: Apr. 6, 1987

[30] Foreign Application Priority Data

Apr. 8, 1986 [FR] France ..... 86 05009

[51] Int. Cl.[4] ..... G21F 9/16

[52] U.S. Cl. ..... 252/629; 252/628; 252/631; 501/12; 501/154; 501/155

[58] Field of Search ..... 252/631, 629, 628; 501/12, 27, 58, 61, 65, 75, 77, 154, 155; 65/17

[56] References Cited

U.S. PATENT DOCUMENTS

| | | | |
|---|---|---|---|
| Re. 32,107 | 4/1986 | January | 252/629 |
| 4,229,317 | 10/1980 | Babad et al. | 252/629 |
| 4,376,070 | 3/1983 | Pope et al. | 252/629 |
| 4,377,507 | 3/1983 | Pope et al. | 252/629 |
| 4,404,105 | 9/1983 | de Lockerente et al. | 252/629 |
| 4,419,115 | 12/1983 | Johnson, Jr. et al. | 501/12 |
| 4,422,965 | 12/1983 | Chickering et al. | 252/629 |
| 4,424,149 | 1/1984 | Bege et al. | 252/629 |
| 4,430,257 | 2/1984 | Pope et al. | 252/629 |
| 4,432,956 | 2/1984 | Zarzycki et al. | 501/12 |
| 4,477,580 | 10/1984 | Fleming, Jr. | 501/12 |
| 4,487,711 | 12/1984 | Pope et al. | 252/629 |
| 4,514,329 | 4/1985 | Wakabayashi et al. | 252/629 |
| 4,681,615 | 7/1987 | Toki et al. | 501/12 |

FOREIGN PATENT DOCUMENTS

| | | |
|---|---|---|
| 0168218 | 1/1986 | European Pat. Off. . |
| 2611689 | 9/1977 | Fed. Rep. of Germany . |
| 1050818 | 12/1966 | United Kingdom . |

*Primary Examiner*—Stephen J. Lechert, Jr.
*Assistant Examiner*—Howard J. Locker
*Attorney, Agent, or Firm*—Marshall & Melhorn

[57] ABSTRACT

The invention relates to a process for the immobilization of nuclear waste in a borosilicate glass.

In the process, the following are mixed simultaneously:

a silica-based gel precursor, a concentrated aqueous solution of a boron compound, and concentrated aqueous solutions of the other constituents of the final glass, i.e. a solution (solutions) of the waste to be treated and a solution of the vitrification adjuvant, with vigorous stirring, mixing taking place at between 20° and 80° C., preferably at 65°-70° C., in proportions corresponding to the desired composition of the glass, the said mixture having an acid pH, preferably a pH of between 2.5 and 3.5, and the said mixture is dried, calcined at between 300° and 500° C. and then melted.

The invention is applied to the treatment of solutions of nuclear waste, especially to solutions of fission products.

17 Claims, No Drawings

PROCESS FOR THE IMMOBILIZATION OF NUCLEAR WASTE IN A BOROSILICATE GLASS

High-level nuclear waste, such as fission products, or nuclear waste with a long half-life, such as actinides, is currently immobilized in borosilicate glasses which offer adequate safety guarantees to man and the environment.

The Atomic Energy Commission (AEC) has developed an industrial process for the vitrification of fission products (FP).

This process (called AVM) consists in calcining the solution of FP and sending the resulting calcinate, at the same time as a glass frit, into a melting furnace. A glass is obtained in a few hours, at a temperature of the order of 1100° C., and is run into metal containers.

The glass frit is composed mainly of silica and boric oxide together with the other oxides (sodium, aluminum etc.) necessary so that the total formulation of calcinate+frit gives a glass which can be produced by the known glassmaking techniques and which satisfies the storage safety conditions (conditions pertaining to leaching, mechanical strength, etc.).

In the melting furnace, the calcinate is digested and becomes incorporated into the vitreous structure. The chosen temperature must be sufficiently high to hasten the digestion, but must not have an adverse effect on the life of the furnace.

To facilitate the formation of a vitreous structure containing all the necessary components, including the FP, the Applicant Company developed a process in which the constituents of the glass are mixed in an aqueous medium to form a gelled solution.

Furthermore, it is known that a glass can be obtained from a gelled solution (or by the so-called "gel method") at temperatures below those required with oxides ("oxide method").

The aim is essentially to manufacture, by the gel method, glasses having the same formulation as those currently prepared by the oxide method, as will be shown in the examples, but any borosilicate formulation acceptable for conditioning waste can be prepared.

In the remainder of the text, the following terms will be employed with the meanings defined below:

vitrification adjuvant: This comprises all the constituents of the final glass other than the constituents originating from the nuclear waste and except for B and Si. This adjuvant therefore contains no active nuclear components. In the AVM process, it is included in a glass frit; in the process forming the subject of the invention, it is an aqueous solution.

final glass: This is the glass in which the nuclear waste is immobilized.

sol: This is a solution of orthosilicic acid; the latter, being unstable, changes by polymerizing. Commercial sols, such as Ludox ® (du Pont de Nemours), are stabilized solutions containing partially hydrated particles of silica; these colloidal particles are polymers whose polymerization has been stopped but can be unblocked, for example by acidification.

gelled solution, or gel: This is a homogeneous solution of variable viscosity, ranging from a solution which flows to a solidified mass, depending on how far the polymerization has advanced.

A method, called the sol-gel method, is known for preparing gels in an aqueous medium; it consists in using a sol in water and destabilizing it by modifying the pH, thus causing this solution to gel.

The following publications refer to this method:

J. SARZYCKI—J. of Materials Science 17 (1982) p 3371-3379

R. Jabra—Revue de Chimie Minérale, t. 16, 1979, p 245-266

J. Phalippou—Verres et Réfractaires, Vol. 35, no. 6, November, December 1981.

The preparation of an $SiO_2$-$B_2O_3$ glass by the sol-gel method is described in the literature:

addition of a solution of Ludox, adjusted to pH 2, to a solution of hydrated ammonium tetraborate, also adjusted to pH 2;

mixing by stirring for 1 h (aqueous ammonia being added, if necessary, to bring the pH of the medium to 3.5, which is very favorable for gelling); if the resulting solution shows no precipitation or flocculation, it is considered to be a satisfactory gel;

drying for 8 h at 100° C. and then for 15 h at 175° C. under a vacuum of 0.1 mm Hg; and hot pressing (450 bar—500 to 900° C.—15 min to 5 h) in order to densify and vitrify the product (an alternative method is melting).

Only binary or ternary glasses have so far been prepared by this method because the presence of a multiplicity of cations makes it difficult to control gelling and even to achieve it.

Thus, to produce a glass having the same composition as the glass frit used in the present vitrification process, the following would be necessary:

$B_2O_3$, $SiO_2$, $Al_2O_3$, $Na_2O$, ZnO, CaO, $Li_2O$, $ZrO_2$.

Now, it is known that:

boron makes gelling very difficult (in the HITACHI process described below, boron is actually added after the gel has formed), particularly because of the high insolubility of a large number of boron compounds, and favors recrystallization in mixed gels;

aluminum favors precipitation to the detriment of gelling, which opposes the desired result; and sodium, calcium and zirconium lead to the formation of crystals which subsequently constitute fragile points capable of causing local destruction.

Due to the multiplicity of components, those skilled in the art are questioning the method of introducing them and the order in which they are introduced.

The complexity of the components in the vitrification process, namely:

those of the vitrification adjuvant ($Al_2O_3$, $Na_2O$, ZnO, CaO, $Li_2O$, $ZrO_2$) plus $B_2O_3$ and $SiO_2$, and at the same time those of the solution of FP to be vitrified (around twenty different cations!), led industrialists to develop two processes based on gels:

(1) Westinghouse and the U.S. Department of Energy developed a process for the vitrification of active solutions involving the preparation of gels, but in an alcoholic medium (alcogels)—U.S. Pat. No. 4,430,257 and U.S. Pat. No. 4,422,965. Their process can be summarized in the following way:

mixing and hydrolysis of the inactive constituents of the gel in an alcohol/water medium, the constituents being introduced in the form $X(OR)_n$, for example $Si(OR)_4$, $B(OR)_3$ etc.;

removal of the water/alcohol azeotrope to give a dry gel;

addition of the solution of nuclear waste (the final compound containing a maximum of 30–40% of waste), adjusted to pH 4 to 6;

drying; and melting.

The gel prepared from compounds $X(OR)_n$ in an alcoholic medium can be obtained more easily because solubility problems are avoided and, furthermore, the peptizing effect of water at high temperature is eliminated by using alcohol.

The major disadvantage of this type of process is that the alcoholic medium is prone to fire, explosion etc., so the alcohol has to be removed before introduction of the nuclear waste; this necessitates an additional operation which is rather impractical to carry out.

(2) The HITACHI process, in which the gel is obtained from the solution of FP in a solution of sodium silicate, the boron (in the form of $B_2O_3$) not being added until after gelling; this necessitates calcining the gel at 600° C., or above, for the time required for the boron to diffuse into the silicate matrix to form the borosilicate structure (for example 3 h); the homogeneity of the product remains a problem.

(3) The publication: N. Uetake—Nuclear Technology, Vol. 67, November 1984

This analysis shows that it seemed impossible to mix the solutions (FP+other components) at the start of the process, not all the components being mutually compatible for the preparation of gels.

The homogeneity of the gel was also a problem. It was necessary to stir, but not too much. In fact, specialists considered that the gel should finish forming at rest for several hours (after mixing by stirring), any stirring being capable of causing local destruction at that stage.

The Applicant Company has found a process for the immobilization of nuclear waste in a borosilicate glass wherein all the constituents of the glass are introduced at the same time into a mixing zone, mixing taking place with vigorous stirring in an aqueous medium under given conditions of temperature (25°–100° C., preferably 65°–70° C.) and pH (acid, preferably between 2.5 and 3.5) and in given proportions (according to the desired composition of the final glass), and the constituents of the glass being composed of:

a silica-based gel precursor, a concentrated aqueous solution of a boron compound, and concentrated aqueous solutions of the other constituents, i.e.:

a solution of the nuclear waste to be treated, and a solution of vitrification adjuvant.

The mixture obtained is dried, calcined (300°–500° C.) and finally melted (1000°–1150° C.) to give the final glass.

Vigorous stirring is defined by the stirring speed: the stirrer rotates at more than 500 rpm, preferably 2000 rpm, and the thickness of the stirred layer (distance between the wall of the vessel and a stirrer blade) does not exceed 10% of the diameter of the blade. The stirrer can be for example a turbine, a mixer or, more simply, a mechanical stirrer rotating in a narrow cross-section.

In the present state of knowledge, there is every reason to think that the stirring must be the more intense and hence the shorter, the greater the risks of precipitation. What is actually required is to create a homogeneous mixture, by stirring, in a time which is very short compared with the precipitation time, and to ensure that the gel forms as quickly as possible so as to solidify the various ions and, by preventing any diffusion of these ions, prevent a possible reaction between the said ions.

The solutions used are concentrated solutions so that a gel is produced quickly and the quantity of water to be evaporated off is minimized, as will be explained in the description and the examples. It is difficult to give an exact concentration limit for each of the compounds, but the concentration of the solutions can reasonably be given as at least 75% of the saturation concentration.

The process can be applied to a variety of solutions of nuclear waste. It is particularly suitable for the vitrification of solutions of FP by themselves or with other active effluents, for example the soda solution for washing the tributyl phosphate used to extract uranium and plutonium, it even being possible for this soda solution to be treated on its own by this process. The solutions of FP are nitric acid solutions originating from reprocessing of the fuel; they contain a large number of elements in various chemical forms and a certain amount of insoluble material. An example of their composition is given below.

The soda effluent is based on sodium carbonate and may contain traces of organic phosphorus entrained by the washing process (Example 3).

In the account of the process, the term "gel precursor" will be used to denote a substance containing particles of silica which may be partially hydrolyzed; it is either in the form of a powder, which can produce a sol when dissolved in acid solution, or directly in the form of a sol.

Examples of gel precursors which are sold commercially and are advantageously used in the process are a sol such as Ludox® or alternatively Aerosil®, which is formed by the hydrolysis of silicon tetrachloride in the gas phase. In an acid medium, Aerosil produces a sol and then a firm gelled mass.

Ludox is used as it is, in solution. Aerosil, on the other hand, can be used either in solution or directly in the form of a powder, depending on the technology employed.

The gel precursor is placed in an acid aqueous medium, in accordance with the process forming the subject of the invention, so that it is converted to a gelled solution by polymerization starting from the Si-OH bonds.

The boron required to form the borosilicate structure is introduced as an aqueous solution of a sufficiently soluble boron compound such as ammonium tetraborate (ATB), which has a solubility of about 300 g/l i.e. 15.1% of $B_2O_3$. Preferably, the solution is produced and used at 65°–70° C. Boric acid can equally well be employed; its solubility is about 130 g/l at 65° C., i.e. 6.5% of $B_2O_3$, and is increased in the presence of $Na^+$ ions when $Na/B \simeq 0.23$ The compounds, containing the desired elements, which are used to prepare the solution of the vitrification adjuvant should be soluble in water at the temperature of the process, be mutually compatible and not add other ions unnecessarily, and their ions which do not participate in the structure of the final glass should be easy to eliminate by heating. An example would be solutions of nitrates in cases where nitric acid solutions of FP are being treated. Solid compounds are always preferably dissolved in the minimum amount of water so as to minimize the volumes treated and the amounts of water to be evaporated off.

The proportions in which these solutions (except for the solutions of waste) are prepared and mixed depend on the desired formulation of the final glass. It can be considered that the constituent components of the glass are not volatilized in practice and that the resulting composition of the final glass virtually corresponds to that of the mixture produced. An acceptable glass formulation is indicated in the examples. The qualitative and quantitative composition of the vitrification adjuvant is adapted according to the composition of the final glass and that of the solution of waste to be treated.

The mixture is prepared at between 20° and 80° C. The solutions to be treated are introduced at their existing temperature; on account of its activity, the solution of FP arrives at the treatment unit at between 20° and 40° C. The concentrated solution of the boron compound is kept at between 50° and 80° C. in order to prevent precipitation. The other solutions are produced at ambient temperature. It is then possible either to mix the solutions at the temperature at which they are produced or arrive, or to heat all the solutions (except for the solutions of waste, which are taken as they are) to a higher temperature before mixing them.

The latter case has the following advantage. After mixing has taken place and the gelled solution has started to form, polymerization (gelling) develops over a so-called ageing period. This is favored by raising the temperature. It is therefore very advantageous to produce the mixture at between 50° C. and 80° C. In the process forming the subject of the invention, the ageing of the gelled solution takes place during drying, preferably at 100°-105° C.

The solutions of the constituents of the glass have different pH values: the gel precursor in solution is acid (for example Aerosil in nitric acid solution) or alkaline (Ludox), the solution of vitrification adjuvant is acid, the solution of waste is acid (in the case of the solutions of FP) or alkaline (in the case of unneutralized washing effluent) and the solution of boron compound is acid (boric acid) or alkaline (ammonium tetraborate). In the process described here, the pH of the mixture must be below 7 and preferably between 2.5 and 3.5. The pH can be adjusted if necessary.

In the process forming the subject of the invention, the mixture from which the final glass is obtained by heating is prepared from all the components in aqueous solution, introduced simultaneously into the mixing zone.

The following components are to be mixed:

| | % of oxide constituents of the glass | Temperature |
|---|---|---|
| A Gel precursor | a % of $SiO_2$ | 25° to 80° C. |
| B Boron solution | b % of $B_2O_3$ | 50° to 80° C. |
| C Solution of waste | c % of oxides | 20° to 40° C. |
| D Vitrification adjuvant | d % of oxides | 50° to 80° C. |

The solutions A, B, C and D arrive separately and simultaneously in a mixing zone (C and D may be introduced together).

Mixing produces a solution called a gelled solution, its viscosity and texture changing with time and ranging from those of a fluid solution to those of a gel. The mixture obtained is dried (preferably at 100°-105° C.), for example in an oven; drying in vacuo is a further possibility. The gel continues to form during this operation. Calcination is then carried out at between 300° and 500° C. (preferably at 350° to 400° C.), during which the water finishes evaporating off and the nitrates partially decompose; analysis shows that, after 2 h at 400° C., 30% of the nitrates are still present under the conditions of the example.

Calcination can be carried out either in a conventional calciner (of the type used in the AVM vitrification process) or in a melting furnace, for example of the ceramic melter type.

The decomposition of the nitrates is always terminated during melting. On entering the furnace, the product rapidly passes from its calcination temperature to its melting point. This is the so-called introduction zone. Then, in the so-called refining zone, it is at a temperature slightly above the melting point; it is then brought to the pouring temperatrre. The value is advantageously between 1035° C. and 110° C., at which the viscosity of the glass, between 200 poises and 80 poises, enables the glass to be poured under good conditions.

The drying-calcination-melting steps described correspond to heat treatments in defined temperature zones and in different equipment. Similar heat treatments in other devices would obviously be suitable, for example drying in an oven followed by introduction into a melting furnace designed with several zones; in general, any technique for producing glass from a gel can be used.

Thus, when a mixture having the AEC formulation is prepared in an aqueous medium by the process forming the subject of the invention, the refining times are found to be shortened: 1.5 h are sufficient where 5 h were necessary in the oxide method. The throughputs of the furnace can therefore be increased.

Furthermore, the formulation produced by the AEC, which is highly satisfactory, can easily be obtained with diverse types of waste.

The process forming the subject of the invention in fact makes it possible to vitrify various types of waste, in particular sodium-rich waste. Sodium improves the fusibility of the glass, but has the disadvantage of rendering it more sensitive to leaching. In the oxide method, the treatment of such waste necessitates modifying the glass frit, but modification is limited by the fusibility.

In the process forming the subject of the invention, the composition of the borosilicate matrix prepared in an aqueous medium is adjusted to the type of waste treated. Thus, for sodium-rich waste, a low-sodium (or perhaps even sodium-free) borosilicate matrix can be produced, as will be shown in the examples.

Another important advantage (not formerly obtained by the other gelling techniques) is that large quantities of gel can be prepared without difficulty using a turbine. In tests, it was possible to reach 40 kg/h of gel very easily, and this does not represent the limit. Equipment of this type, which is simple and capable of being disassembled, can be adapted to the safety constraints applied to nuclear plants.

Examples are now given in order to provide a clearer understanding of the novelty of the process forming the subject of the invention, compared with the state of the art, the first example consisting of an attempt to produce a gelled solution from the teaching of the prior art.

EXAMPLE 1

A Conventional Process for the Preparation of Gels, Applied to the Treatment of a Simulated Solution of FP

The Solutions

On the laboratory scale, a solution of FP was simulated using a typical composition of a real solution of FP in the following manner:

| | Product used | Quantity (g) | Corresponding quantity of oxide (g) |
|---|---|---|---|
| 1 | $Al(NO_3)_3.9H_2O$ | 117.6 | 15.9 |
| | $Fe(NO_3)_3.9H_2O$ | 146.7 | 29 |
| | $Ni(NO_3)_2.6H_2O$ | 19.4 | 5 |
| | $Cr(NO_3)_2.9H_2O$ | 26.3 | 5 |
| | $Na_4P_2O_7.10H_2O$ | 9.4 | 5.6 |
| | $NaNO_3$ | 103.6 | 37.7 |
| 2 | $Sr(NO_3)_2$ | 6.7 | 3.2 |
| | $CsNO_3$ | 15.2 | 10.9 |
| | $Ba(NO_3)_2$ | 9.7 | 5.6 |
| | $ZrO(NO_3)_2.2H_2O$ | 34.7 | 15.9 |
| | $Na_2MoO_4.2H_2O$ | 26.4 | 22.5 |
| | $Co(NO_3)_2.6H_2O$ | 5.8 | 1.4 |
| | $Mn(NO_3)_2.4H_2O$ | 27.7 | 9.5 |
| | $Ni(NO_3)_2.6H_2O$ | 18.3 | 4.6 |
| | $Y(NO_3)_3.4H_2O$ | 5.5 | 1.7 |
| | $La(NO_3)_3.6H_2O$ | 23.7 | 8.8 |
| | $Ce(NO_3)_3.6H_2O$ | 24.9 | 9.3 |
| | $Pr(NO_3)_3.4H_2O$ | 10.6 | 4.3 |
| | $Nd(NO_3)_3.6H_2O$ | 39.6 | 15.1 |
| | $ZrO_2$ | 4.6 | 4.6 |
| | Mo | 3.5 | 5.3 |
| | $U_3O_8$ | 8.8 | 8.5 |

Group 1 represents the inactive components of the solution of fission products and group 2 represents the FP and the insoluble materials in the same solution.

$ZrO_2$ and Mo remain solid; they simulate the insoluble materials. The total quantity of water added in 2972 g.

The simulated solution of FP has a pH of 1.3. The composition of the final glass to be obtained is:

| Composition of the glass | | introduced via |
|---|---|---|
| $SiO_2$ | 45.5% | Ludox |
| $B_2O_3$ | 14% | Solution of ATB |
| $Al_2O_3$ | 4.9% | Solution of the adjuvant |
| $Na_2O$ | 9.8% | and solution of FP |
| ZnO | 2.5% | " |
| CaO | 4.1% | " |
| $Li_2O$ | 2% | " |
| Active oxides | 13.2% | Solution of FP |
| $Fe_2O_3$ | 2.9% | " |
| NiO | 0.4% | " |
| $Cr_2O_3$ | 0.5% | " |
| $P_2O_5$ | 0.3% | " |

In the percentage composition shown, it is necessary to allow for the presence of sodium and nickel in the active oxides (originating from group 2 of the solution defined above).

Thus, the solutions of the vitrification adjuvant are prepared according to the composition of the glass to be obtained and the composition of the solution of waste to be treated.

For this example, the separate solutions of vitrification adjuvant are thus prepared at ambient temperature:

| Product used | Quantity (g) | Quantity taken |
|---|---|---|
| Al nitrate solution | 60 g of $Al(NO_3)_3.9H_2O$ per 100 $cm^3$ of water | 41.7 g |
| Na nitrate solution | 90 g of $NaNO_3$ per 100 $cm^3$ of water | 22.3 g |
| Zn nitrate solution | 180 g of $Zn(NO_3)_2.6H_2O$ per 100 $cm^3$ of water | 9.1 g |
| Ca nitrate solution | 265 g of $Ca(NO_3)_2.4H_2O$ per 100 $cm^3$ of water | 15.2 g |
| Li nitrate solution | 90 g of $LiNO_3$ per 100 $cm^3$ of water | 12.5 g |

The precursor is Ludox AS40: 40% $SiO_2$/60% $H_2O$; $d_{25°C}$: 1.30; pH: 9.3; used at ambient temperature. ATB solution: $(NH_4)_2O.2B_2O_3.4H_2O$; 265.2 g dissolved in 663 g of water at 65° C.; pH: 9.2.

The Procedure 59 g of ATB solution are placed in a 1 l beaker equipped with a magnetic stirrer (7 cm bar) rotating at 500 rpm, and adjusted to pH 2 by the addition of $HNO_3$.

In another beaker, 56 $cm^3$ of Ludox are acidified to pH 2 in order to prevent the subsequent precipitation of hydroxides such as $Al(OH)_3$ at pH 5–6 or $Zn(OH)_2$ at pH 4.8.

The Ludox solution is introduced into the ammonium tetraborate, with stirring, the reaction taking place at 65° C.–70° C. The mixture is stirred (magnetic or mechanical stirrer) for 30 min, the temperature being maintained. To accelerate gelling, a small quantity of dilute aqueous ammonia (0.15 N) is added to bring the pH to 3. Gel formation takes place.

Each solution of adjuvant is added separately to the mixture, slowly (dropwise) and with stirring. Stirring is continued for 5 to 10 min. The mixture obtained, which is called the gel, shows no visible precipitation or flocculation. 235 g of the simulated solution of FP are added slowly (dropwise), with stirring. Precipitates are formed.

To obtain solidification, the mixture is left to stand at 65° C.–70° C.; at least 20 h are required to give a mass; as soon as this is obtained, it is dried in an oven (90 h at 110° C.) and then melted at between 1000° and 1150° C.

Analysis shows that the molybdenum which has deposited has not been included homogeneously in the glass; traces of molybdate are also visible. The glass obtained is not acceptable.

With this process, only small quantities of gels (≃100 to 500 ml) could be prepared. Gel could not be obtained with 1 l of solution (precipitation occurs).

The solutions of the constituents of the glass have to be introduced separately, or together if they are mutually compatible; precipitation is otherwise observed, making the gel non-homogeneous. The gel and the final glass are not always of good quality.

Moreover, with this conventional process, it was never possible to introduce the simulated solution of waste correctly. Precipitation and sedimentation were observed, the consequence being the need for a higher melting temperature and/or a longer digestion time, or the production of an unacceptable final glass.

In the tests, a glass of good quality was defined as being a homogeneous glass having no unmelted regions and no bubbles and also showing no traces of molybdate on the surface.

The molybdate originating from the solutions of FP actually presents a major problem: part of the active Mo tends to separate out from the solution and deposit, so this phase is not completely dispersed in the mixture and hence is not totally included in the gelled solution. Furthermore, when it diffuses poorly, the molybdenum appears on the surface of the glass in the form of visible yellow traces of molybdate, which are considered to be an indication of inferior quality.

EXAMPLE 2

Treatment of a Solution of Fission Products by the Process of the Invention

The Solutions

These are the same as those of Example 1, except for the solution of vitrification adjuvant.

For this example, the solution of vitrification adjuvant is prepared as follows:

| Product used | Quantity (g) | Corresponding quantity of oxide (g) |
|---|---|---|
| $Al(NO_3)_3.9H_2O$ | 243.6 | 33.1 |
| $NaNO_3$ | 148.4 | 54.1 |
| $Zn(NO_3)_2.6H_2O$ | 91.4 | 25 |
| $Ca(NO_3)_2.4H_2O$ | 170.1 | 40.4 |
| $LiNO_3$ | 91.4 | 19.8 |

Each of the compounds is dissolved in the minimum quantity of water, i.e. a total of 640 g of water at 65° C.; pH: 0.6.

The proportions of the elements Al, Na, Zn, Ca and Li are the same as in Example 1.

The Device

The device used is a conventional turbine having a mixing zone of small volume, in which a propeller with several blades rotates so as to effect mixing at a high rate of shear. It rotates at 2000 rpm in this example.

The turbine used for the tests is manufactured by the Company STERMA, the mixing zone has a volume of 1 $cm^3$ and the thickness of the stirred layer is of the order of mm. For use on the industrial scale in a nuclear environment, some technical improvements will be required, especially as regards the geometry of the blades and the introduction of the solutions; the purpose of these improvements is to facilitate operation in an active closed cell.

The Procedure

The solutions arrive at the turbine separately and simultaneously:

| | pH | T° | Flow rate at T° | Composition of the solution |
|---|---|---|---|---|
| Ludox | 9.3 | 20° C. | 5.7 kg/h | 40% of $SiO_2$ |
| Ammonium tetraborate.$4H_2O$ | 9.2 | 65° C. | 4.7 kg/h | 21% of anhydrous salt, i.e. 15% of $B_2O_3$ |
| Solution of vitrification adjuvant + Simulated solution of FP | 0.6<br>1.3 | 65° C. | 7 kg/h<br>18.4 kg/h | 40% of anhydrous salt, i.e. 12% of oxides + 14% of anhydrous materials, i.e. 6% of oxides |

The solutions of vitrification adjuvant and FP are pumped at the indicated flow rate and it is the mixture of these which is sent to the turbine at the overall flow rate of 25.4 kg/h. Thus, there is a flow rate of 36 kg/h of gel. The pH of the gelled solution leaving the turbine is 3.

In this test, 12 min sufficed to mix the constituents and produce 7 kg of gelled solution.

The following heat treatments were carried out on 3 samples:

Test 1

10.5 kg of mixture were concentrated in vacuo in an apparatus manufactured by the Company GUEDU (T: 90° C., P: 630 mm Hg). 6.5 l of water were extracted. The mass recovered (3.5 kg) is calcined for 2 h at 400° C. to give 1.8 kg of product, which is melted at 1050° C. for 5 h. A glass of good quality is obtained.

Test 2

5 kg of mixture are dried for 3 days at 105° C. to produce 1.2 kg of dry product; this is then heated for 2 h at 400° C., when it loses 27.5% of its weight. Melting for 5 h at 1025° C. gives 820 g of a glass of good quality which pours well. In this test, it was observed that a gel was obtained en masse in less than 30 min at 105° C.

Test 3

3 kg of mixture, spread over a plate with a thickness of 2–3 cm and placed for 8 h in a microwave furnace, gave 550 g of product, which, after 2 h at 400° C. (the temperature being raised uniformly from the drying temperature to 400° C.), reduce to 502 g of calcined product. Melting at 1125° C. takes only 1.5 h (including refining for 1 h) to produce a glass of very good quality which pours well.

In conclusion, a gel obtained in this way, treated for 8 h in a microwave furnace, calcined for 2 h at 400° C. and then melted for 1.5 h at 1125° C. (refining for 1 h), leads to a glass of very good quality which is acceptable for the immobilization of nuclear waste and represents a time saving of the order of 3 to 4 h compared with the process currently in use.

Replacement of the Ammonium Tetraborate With Boric Acid

The ATB solution containing 15% of $B_2O_3$ is replaced with an $H_3BO_3$ solution containing 6.5% of $B_2O_3$, formed by dissolving 130 g of solid boric acid in 1 l of water at 65°–70° C., with stirring (pH=2.7).

Consequently the flow rate of boron compound is 10.8 kg/h in $H_3BO_3$ solution, the other solutions being conveyed at the same flow rates.

This gives about 42 kg/h of mixture, which, when treated in the same way as previously, leads to similar products.

EXAMPLE 3

The Treatment of a Soda Effluent Used For Washing

At the present time, in the vitrification (AVM) process based on the oxides, it is not possible to treat this soda effluent.

In fact, this AVM process uses the vitrification adjuvant in the form of a solid glass frit, a known composition being:

| | |
|---|---|
| $SiO_2$ | 55–60% by weight |
| $B_2O_3$ | 16–18% by weight |
| $Al_2O_3$ | 6–7% by weight |
| $Na_2O$ | 6–7% by weight |
| CaO | 4.5–6% by weight |

-continued

| | |
|---|---|
| ZnO | 2.5-3.5% by weight |
| $Li_2O$ | 2-3% by weight |

This composition limits the quantity of sodium permissible in the effluent to be vitrified, since the sodium level cannot be increased excessively, thereby lowering the leaching resistance.

One might consider reducing the level of sodium in the glass frit, even to zero, so that the final glass (frit+-calcinate of soda effluent) has an acceptable sodium level (9 to 11% by weight). However, one is then faced with the difficulty of producing and melting a glass which is poor in sodium (and consequently richer in silica).

The present invention makes it possible to produce, with the soda effluent, a borosilicate glass having a composition similar to that which proves totally satisfactory in the AVM process. Moreover, the refining temperature can be considerably lowered or the refining times shortened.

For tests, a soda solution was therefore simulated using 120 g of $Na_2CO_3$ in 1 l of water (pH=9). The chosen gel precursor is Ludox AS40. The ATB solution contains 312 g/l of ATB.$4H_2O$.

To obtain a glass having the same composition as that obtained by the AVM process, the following solution of vitrification adjuvant is prepared (amounts are per liter of aqueous solution):

| | |
|---|---|
| $Al(NO_3)_3.9H_2O$ | 209.0 g |
| $Ca(NO_3)_2.3H_2O$ | 98.5 g |
| $LiNO_3$ | 53.7 g |
| $Zn(NO_3)_2.6H_2O$ | 49.7 g |
| $Fe(NO_3)_3.6H_2O$ | 73.5 g |
| $Mn(NO_3)_3.6H_2O$ | 18.2 g |
| $Ba(NO_3)_2$ | 5.5 g |
| $Co(NO_3)_2.6H_2O$ | 11.3 g |
| $Sr(NO_3)_2$ | 4.1 g |
| $CsNO_3$ | 8.0 g |
| $Y(NO_3)_3.4H_2O$ | 71.0 g |
| $Na_2MoO_4.2H_2O$ | 16.6 g |
| Monoammonium phosphate | 2.8 g |

The components Fe, Mn . . . phosphate were introduced into this solution so as to give a final glass with a composition similar to that given in Example 2.

Each of the solutions is kept in a thermostatically controlled bath (temperature: 65° C.). 4 diaphragm pumps are provided, which have been adjusted beforehand to give the desired flow rates.

These solutions are pumped simultaneously into a high-speed mixer (capacity: 1.5 l).

The set flow rates are:

| | |
|---|---|
| ATB solution | 0.12 kg/h |
| Adjuvant solution | 0.25 kg/h |
| Ludox solution | 0.15 kg/h |
| $Na_2CO_3$ solution | 0.21 kg/h |

The process is continued for 1.5 h with vigorous stirring all the time. The contents of the mixer bowl are poured into a beaker and left to stand for 2 h. A virtually solid, homogeneous mass of opalescent color is formed. This mass is spread over a plate to form an approx. 20 to 30 mm thick layer and the plate is placed in an oven heated to 105° C. for 24 h.

This gives dry particles of the order of $cm^3$. These are placed in a calcining furnace and the temperature is raised uniformly to 400° C. over 3 h and maintained for 3 h. The calcinate obtained is crushed into particles of 1 to 3 mm.

A Joule-effect electric furnace of sufficient capacity is set to 1150° C. A platinum crucible is filled with a third of the powder prepared and is placed in the furnace. After 30 min, the crucible is filled with another third of the powder; this procedure is repeated with the final third. The crucible is left in the hot furnace for a further 2 h and the contents are then poured onto a plate made of refractory material. The product is annealed at 500° C. for 8 h to give the sample a satisfactory surface, and the temperature is lowered slowly; this produces an intense black plate of glass of perfect visual homogeneity.

Chemical analysis gives the following average composition:

| | |
|---|---|
| $SiO_2$ | 45.6% |
| $B_2O_3$ | 14% |
| $Al_2O_3$ | 4.9% |
| $Na_2O$ | 10% |
| CaO | 4% |
| $Li_2O$ | 2% |
| $Fe_2O_3$ | 2.9% |
| $MnO_2$ | 0.95% |
| BaO | 0.55% |
| CoO | 0.5% |
| $Cs_2O$ | 1% |
| SrO | 0.35% |
| $Y_2O_3$ | 4% |
| $MoO_3$ | 2% |
| $P_2O_5$ | 0.3% |

This example shows how the composition of the vitrification adjuvant can be adjusted.

EXAMPLE 4

Treatment of the Soda Effluent With Aerosil

The solutions of vitrification adjuvant, ATB and waste are the same.

On the other hand, Aerosil®, marketed by the firm DEGUSSA, will be used instead of Ludox AS40 as the gel precursor. The gel precursor is formed by pouring the Aerosil gradually, with stirring, into water acidified with 3N $HNO_3$ (pH: 2.5), so as to give a solution containing 150 g of silica per liter.

The flow rates are adjusted to the values indicated:

ATB: 0.37 kg/h

Adjuvant: 0.75 kg/l

Aerosil: 1.3 kg/h $Na_2CO_3$ solution: 0.63 kg/h

The procedure is identical to Example 1 above in all respects except the drying step, which is accomplished in a vacuum oven; this makes it possible to reduce the time to 4 h. The result is the same. The two glasses cannot be distinguished. In particular, the same chemical analysis is found (within the limits of experimental error).

The two Examples 3 and 4 illustrate the invention as applied to the treatment of the soda effluent with different gel precursors, but they do not imply a limitation. In particular, they can be combined to vary the procedure, without going outside the framework of the invention, for example by introducing the silica in the form of both Ludox and Aerosil simultaneously.

In Examples 3 and 4, the neutralized soda effluent was treated on its own. It is obviously advantageous to treat the unneutralized soda effluent (i.e. in the form in which it leaves the extraction units) at the same time as the solutions of FP, which contain nitric acid, so as not to consume excessive amounts of nitric acid and increase the volumes of waste. To do this, the water used to scrub the nitrous vapors, which contains nitric acid, is added to the soda effluent to neutralize it, the resulting liquid being mixed with the solution of FP in fixed proportions. The solution of vitrification adjuvant will then be adapted to this treatment.

All the solutions were prepared in the minimum quantity of water—they are close to saturation point—so as not to increase the drying times, the volumes of liquid to be handled or the active gaseous discharges, since the water to be evaporated off is contaminated by radioisotopes and the operator is obliged to treat the said discharges. For reasons of pumping or flows, it may be necessary to dilute these solutions more, but this has no adverse effect on the process.

Furthermore, in the examples, the boron compound used is ammonium tetraborate tetrahydrate, thereby affording easier comparison with the prior art. However, in the existing vitrification plants, the use of ATB presents problems as regards the treatment of the gaseous effluents rich in ammonia and nitrous vapors, which are liable to recombine to produce ammonium nitrate, this being dangerous under certain conditions.

For these reasons, boric acid is preferred under the conditions of the process forming the subject of the invention.

Thus, the description clearly shows that the process developed by the Applicant Company differs from the HITACHI process described in the prior art in that all the components of the final glass are introduced simultaneously to form a gelled solution. In contrast to the HITACHI process, the boron is introduced before rather than after gel formation. It therefore forms part of the structure right from the start, whereas, in the HITACHI process, it is dispersed in the previously produced silicate structure.

The Applicant Company is of the opinion that the gelled solution produced by the process according to the invention forms more rapidly than the compounds can react with one another to give a precipitate. The gelled solution obtained has the structure of the desired final glass and the ions can no longer migrate in this solution.

It is in fact considered that, during mixing under the conditions indicated, the phenomenon of thixotropy occurs so that a homogeneous dispersion of the ions is produced. After this mixing stage, the viscosity of the solution increases, trapping the ions in the medium. They are no longer able to react (precipitation, sedimentation etc.) and the medium is "frozen".

According to the Applicant Company, this effect is due to the choice of solutions used and the method of stirring employed to mix them.

What is claimed is:

1. A process for the immobilization of nuclear waste in a borosilicate glass, wherein:
   the following are mixed simulataneously:
   a silica-based gel precursor,
   a concentrated aqueous solution of a boron compound, and
   concentrated aqueous solution of the waste to be treated and a solution of a vitrification adjuvant,
   with vigorous stirring, mixing taking place at between about 20° and 80° C., in proportions corresponding to the desired composition of the glass, the said mixture having an acid pH; and
   the said mixture is dried, calcined at between 300° and 500° C. and then melted.

2. The process as claimed in claim 1, wherein mixing is effected with a stirrer which rotates at more than about 500 rpm.

3. The process as claimed in claim 1 in which the mixing is at about 65° to 70° C.

4. The process as claimed in claim 1, wherein the gel precursor is a sol.

5. The process as claimed in claim 1, wherein the gel precursor is alkaline colloidal silica.

6. The process as claimed in claim 1, wherein the gel precursor is acid colloidal silica.

7. The process as claimed in claim 1, wherein the boron compound is ammonium tetraborate.

8. The process as claimed in claim 1, wherein the boron compound is boric acid.

9. A process for immobilizing nuclear waste in the form of a liquid aqueous solution as a waste material, the process comprising the steps of:
   A. simultaneously mixing glass-forming materials in an aqueous system, the ingredients comprising:
      1. a silica gel precursor for forming silica in the final glass, the precursor being an aqueous suspension of colloidal silica;
      2. a boron compound in an aqueous solution for forming boron oxide in the final glass; and
      3. an aqueous solution of nuclear waste including uranium as a waste material and a solution of a vitrification adjuvant, the mixing being done at an acid pH and a temperature of about 20° to 80° C. to provide a gel solidified material;
   B. drying the resultant solidified material mixture;
   C. calcining the dried mixture of Step B at a temperature of about 300° to 500° C.;
   D. melting the calcined product of Step C to form a melted glass; and
   E. solidifying the melted glass to form a borosilicate glass that encapsulates the nuclear waste material.

10. A process as defined in claim 9 in which other constituents of the final glass are added in Step A, the adding being simultaneous with the glass forming materials, the other constituents comprising a solution of an aluminum compound that forms A1203 in the final glass.

11. A process as defined in claim 10 in which the other constituents comprises solutions of glass-forming compounds that form $Na_2O$, ZnO, $C_aO$ and $ZrO_2$ in the final glass.

12. A process as defined in claim 9 in which Step A is performed at about 65° to 70° C.

13. A process as defined in claim 12 in which the aqueous system of Step A has a pH of about 2.5 to 3.5.

14. A process as defined in claim 9 in which the drying Step B is about 100° to 105° C.

15. A process as defined in claim 9 in which Step C is conducted at about 350° to 450° C.

16. A process as defined in claim 9 in which the silica gel precursor is alkaline colloidal silical that provides a gel to provide the solidified mixture of Step A.

17. A process as defined in claim 9 in which the aqueous solution of 1 and 2 in Step A are concentrated in which the solutions are at least about 75% of their saturation concentrations.

* * * * *